US008807151B2

(12) United States Patent
Büsing et al.

(10) Patent No.: US 8,807,151 B2
(45) Date of Patent: Aug. 19, 2014

(54) FREESTANDING HOUSEHOLD APPLIANCE

(75) Inventors: Johannes Büsing, Emersacker (DE); Cengiz Kücük, Syrgenstein (DE); Michael Lugert, Jettingen-Scheppach (DE); Martin Stickel, Giengen/Brenz (DE); Wilhelm Thibaut, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1007 days.

(21) Appl. No.: 12/922,867

(22) PCT Filed: Mar. 27, 2009

(86) PCT No.: PCT/EP2009/053695

§ 371 (c)(1),
(2), (4) Date: Sep. 16, 2010

(87) PCT Pub. No.: WO2009/121818

PCT Pub. Date: Oct. 8, 2009

(65) Prior Publication Data

US 2011/0012485 A1 Jan. 20, 2011

(30) Foreign Application Priority Data

Mar. 31, 2008 (DE) ..... 10 2008 016 483

(51) Int. Cl.

| | |
|---|---|
| ***F16M 13/02*** | (2006.01) |
| ***F16M 13/00*** | (2006.01) |
| ***A47L 15/42*** | (2006.01) |
| ***D06F 39/00*** | (2006.01) |

(52) U.S. Cl.

CPC ..... *D06F 39/001* (2013.01); *A47L 15/4223* (2013.01); *A47L 15/4217* (2013.01); *A47L 15/427* (2013.01)

USPC ..... 134/201; 248/500; 248/550; 248/680; 312/228

(58) Field of Classification Search

USPC ..... 134/201; 248/500, 550, 680; 312/228

See application file for complete search history.

(56) References Cited

U.S. PATENT DOCUMENTS

| | | | | |
|---|---|---|---|---|
| 4,669,695 | A * | 6/1987 | Chou | 248/500 |
| 5,076,525 | A | 12/1991 | Whipple | |
| 5,624,098 | A * | 4/1997 | McDowell | 248/550 |
| 6,220,562 | B1 * | 4/2001 | Konkle | 248/500 |
| 6,281,480 | B1 | 8/2001 | Haberstetter | |
| 6,533,238 | B2 * | 3/2003 | Barnes et al. | 248/680 |
| 2003/0010886 | A1 * | 1/2003 | Barnes et al. | 248/680 |
| 2009/0001246 | A1 * | 1/2009 | Phillips et al. | 248/680 |
| 2009/0074535 | A1 | 3/2009 | Roberts et al. | |
| 2009/0252548 | A1 | 10/2009 | Laible et al. | |

FOREIGN PATENT DOCUMENTS

| | | | |
|---|---|---|---|
| DE | 9014188 | U1 | 2/1991 |
| DE | 19748703 | A1 | 5/1999 |
| EP | 1172061 | A1 | 1/2002 |
| JP | 2007097712 | A | 4/2007 |

* cited by examiner

*Primary Examiner* — Michael Barr
*Assistant Examiner* — Benjamin L Osterhout
(74) *Attorney, Agent, or Firm* — James E. Howard; Andre Pallapies

(57) ABSTRACT

A household appliance including a mounting aid that has at least two functional parts that are separated from one another by at least one separation point.

28 Claims, 4 Drawing Sheets

FREESTANDING HOUSEHOLD APPLIANCE

BACKGROUND OF THE INVENTION

The invention relates to a freestanding household appliance, especially to a dishwasher.

Household appliance such as dishwashers, washing machines, dryers, refrigeration appliances or ovens for example, are supplied to end customers as built-in appliances or freestanding appliances, along with mounting aids each fulfilling a particular function, for example a hose holder for water-conducting household appliances such as a dishwashers or washing machines, operating instructions, an anti-tip part or an attachment bracket for built-under appliances. The number of mounting aids to be provided with the appliance is increasing in line with the plurality of functions.

BRIEF SUMMARY OF THE INVENTION

The object of the invention is thus to reduce the number of mounting aids to be supplied with the appliance.

The invention is based on a freestanding household appliance, especially a dishwasher, having at least one mounting aid.

Achieving the object of the invention is characterized by the mounting aid having at least two functional parts that are designed to be separable from one another by way of at least one separation point. The number of individual parts supplied with the household appliance is thereby reduced in a surprisingly simple manner.

In this instance the separation points could typically be realized as detachable snap connections. Preferably however there is provision for the at least one separation point to be embodied as an intended break or bending point. If necessary the respective functional part can be taken from its assembled position into a usage position separated from the mounting aid. For this purpose the functional part is separated from the mounting aid at the separation point.

In addition there is preferably provision for the mounting aid to be embodied in a uniform material and in one piece. This allows the mounting aid to be manufactured without mounting the sections of the mounting aid assigned to the functions. In addition further functional parts can be molded in this way in a captive manner onto the hose holder element.

In a preferred embodiment there is provision for a functional part to be embodied as a hose holder. In this case the functional part embodied as the hose holder, when a water-conducting household appliance such as a dishwasher or washing machine is set up or installed for example, allows positioning or inlet and/or drain hose without forming a siphon.

In a further preferred embodiment there is provision for a functional part to be embodied as an attachment bracket for securing the household appliance against being pulled out of its built-in position. Thus, in its usage position the attachment element secures a household appliance embodied as a built-in household appliance, such as dishwashers, refrigerators or oven against being pulled out of its built-in position. The functioning of the attachment element is known per se.

In a further preferred form of embodiment there is provision for one functional part to be embodied as an anti-tip part. The anti-tip part, in its usage position separated from the mounting aid, can be in contact with an adjoining wall and simultaneously engaging with the household appliance. The function of the anti-tip part is generally known. It is designed to counteract a tipping moment which can be exerted when the household appliance door is opened on the domestic appliance, such as a dishwasher or a refrigerator for example.

The anti-tip part can preferably be embodied with a securing arm and a mounting arm in an L-shape. In the usage position the securing arm can be in contact with the container of the household appliance. By contrast the mounting arm can be used for wall mounting.

To this end an additional mounting flange can be formed onto the mounting arm for screwing it to the wall.

It is advantageous for the securing arm of the anti-tip part to be able to be easily brought into contact with the household appliance in mounting terms. To this end the securing can feature a downwards-pointing recess in which a corresponding angled position of the household appliance a rear-side connecting flange of the household appliance container can be inserted. In the end position the connecting flange extends to make a form fit into the recess of the securing bracket.

In a further preferred embodiment there is provision for a functional part to be embodied as a hook for suspension of additional parts to enable additional parts to be suspended.

The mounting aid can preferably feature at least one first attachment point for holding it onto the household appliance. This attachment point can for example be a hook section with which the mounting aid can be suspended on a connecting flange of a container of the household appliance. The above-mentioned first attachment point of the mounting aid can be provided on a functional part.

The mounting aid can also preferably feature a second attachment point for wall mounting independently of the household appliance. The second attachment point can be used if the functional part has been separated from the basic body of the mounting aid. In this case the first attachment point mentioned above is separated together with the functional part from the basic body of the mounting aid.

The basic body of the hose holder element can preferably be a base plate onto the narrow sides of which functional elements are preferably molded. In this case the functional elements and the base plate can preferably merge into each other with a flush surface. In this way the base plate together with the functional elements provides a common contact surface which can for example be brought into contact with a rear wall of the container.

Preferably cutouts can be provided on the securing arm of the anti-tip part and preferably these can be arranged offset in relation to each other in a depth direction. The mounting aid can thus be used for differently dimensioned containers. Depending on the embodiment of the container the first or the second attachment point can be used.

Provision is also preferably made for the mounting aid to be a plastic injection-molded part. To this end the injection molding tools are to be designed so that in the injection molding chamber delimited by them the basic body is able to be molded jointly with the functional parts integrated into it.

In addition there is preferably provision for the mounting aid to be an injection molded part.

There is further preferably provision for the mounting aid to be arranged outside on the housing of the household appliance, for example on a rear wall of the housing of the household appliance.

Finally there is preferably provision for the number of functional parts of the mounting aid to be the same or greater than the number of separation points. I.e. the mounting aid can be split by means of the separation point into a number of elements, with a least one of the elements being assigned more than one functional part. This allows an especially simple design of the mounting aid since the number of separation points is minimized.

A mounting aid for an inventive household appliance also belongs to the invention.

BRIEF DESCRIPTION OF THE DRAWINGS

An exemplary embodiment of the invention is described below with reference to the enclosed figures. The figures show.

DETAILED DESCRIPTION OF EXEMPLARY EMBODIMENTS OF THE PRESENT INVENTION

Figure 1:
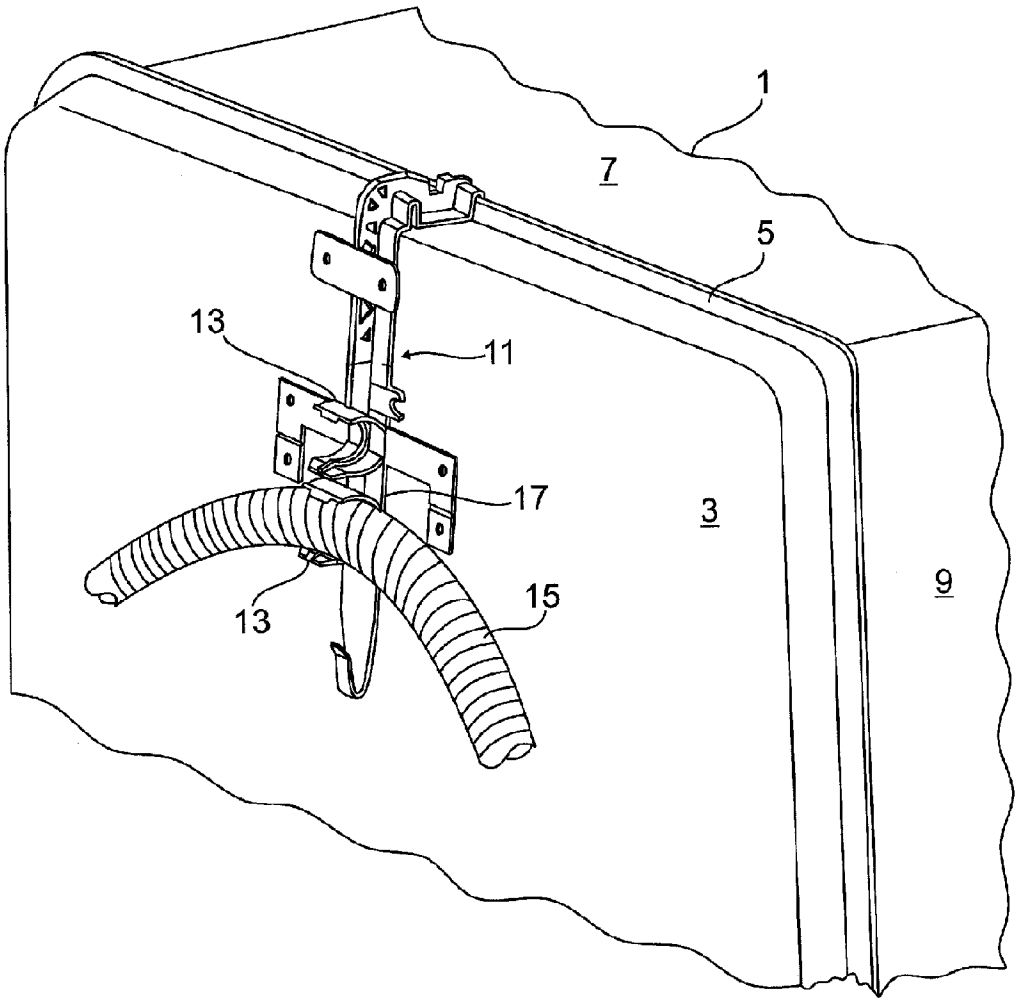
FIG. 1 the mounting position of the mounting aid on the rear wall of a washing container of a dishwasher in a perspective part view.

FIG. 1 shows a prospective part of view of the rear side of a washing container 1 of a dishwasher. The rear side of the washing container 1 is closed off by a rear wall 3. The rear wall 3 is connected via a connecting flange 5 with a box-shaped metal casing which forms the top wall 7 as well as the side walls 9 and the bottom wall not shown in the diagram of the washing container 1.

On the other side of the washing container 1 a mounting aid 11 is suspended from the connecting flange 5. The mounting aid 11 is a plastic injection molded part and has as its functional parts two hose holders 13 arranged above one another in which respectively a water feed hose 15 shown in the diagram as well as they water drain hose not shown can be held.

Figure 2:
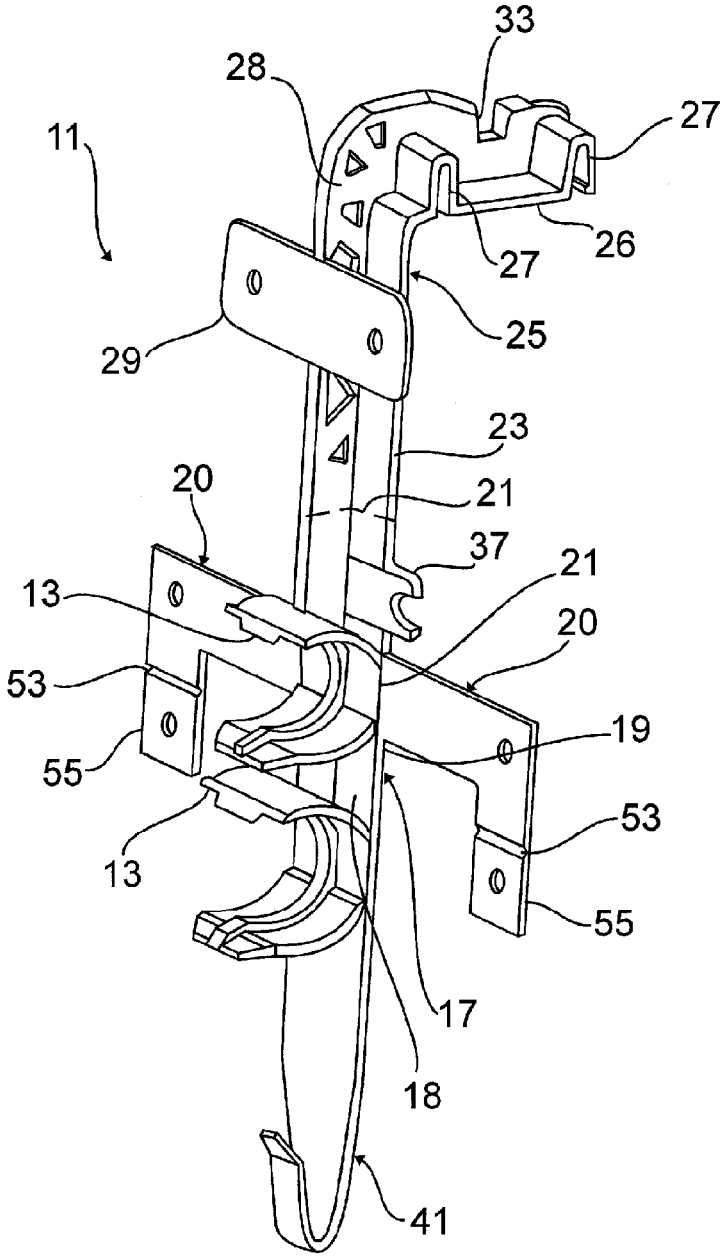
FIG. 2 the mounting aid on its own in a perspective view.

The mounting aid 11 is shown on its own in FIG. 2. Accordingly the mounting aid 11 has a base plate 17 as its basic body, on the front side 18 of which the two hose holders 13 are embodied. On their two narrow edge sides 19 an attachment brackets 20 is molded in each case as a further functional part, which is provided with a separation point 21 in the area of the edge sides 19. The separation point 21 is an intended break or bending point which can be embodied as a narrowing of the material.

The two attachment brackets 20 are used to secure the dishwasher against being pulled out of its fitted position. The mounting as well as the functioning of the attachment brackets 20 will be described below with reference to FIG. 5.

As can also be seen from FIG. 2, the base plate 17 is extended vertically upwards in a uniform material and in one piece with a mounting arm 23 of an L-shaped anti-tip part 25 which serves as a further functional part. The mounting arm 23 becomes an angled securing arm 27 which features first attachment points for suspending the installation aid 11 designed as recesses 27 on the dishwasher, as is shown in FIG. 1. In accordance with FIG. 1 the mounting aid 11 is hung via one of the two recesses 27 on the securing arm 26 of the anti-tip part 25.

The mounting aid 11 is also provided with a reinforcing rib 28. This extends along a lengthwise central axis of the base plate 17 of the mounting arm 23 and of the securing arm 26 and increases the form stability of the mounting aid 11.

Figure 3:
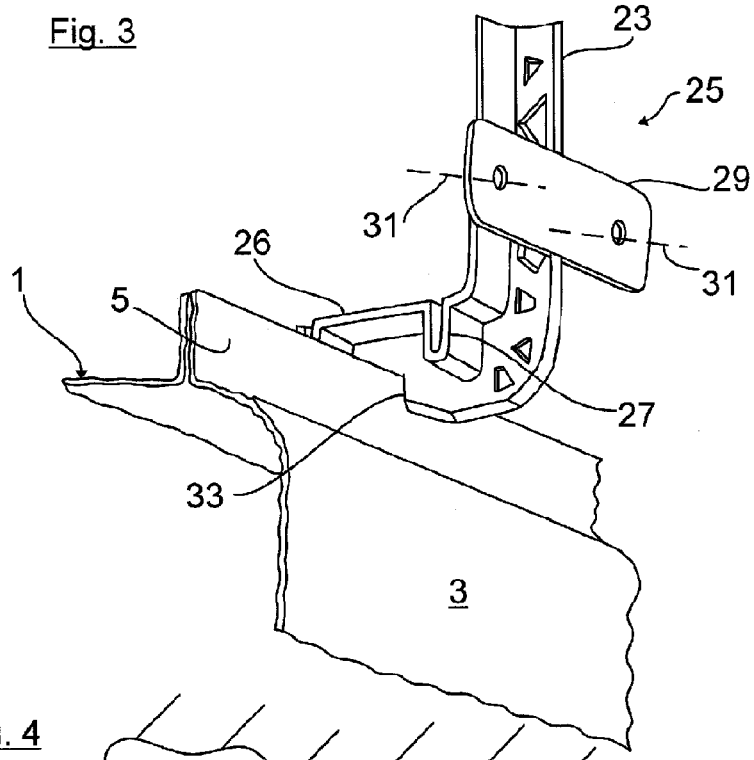
FIG. 3 an anti-tilt part separated from the mounting aid in its usage position.

If necessary the anti-tip part 25 molded onto the basic body 17 can be separated at the separation point 21. The anti-tip part 25 separated in this way is then mounted rotated by 180° with its upwards pointing mounting arm 23 on a wall. The usage position of the separated anti-tip part 25 is shown in FIG. 3. Accordingly the mounting arm 23 additionally has an attachment flange 29 with screw holes which are connected by the screw connection 31 with a mounting wall not shown.

In accordance with FIG. 3 a recess 33 pointing downwards is provided in the securing arm 26 into which the connecting flange 5 of the washing container 1 projects. To insert the connecting flange 5 into the recess 33 of the anti-trip part 25, the dishwasher is put into an angled position and is tilted with its connecting flange 5 into the recess 33.

Figure 4:
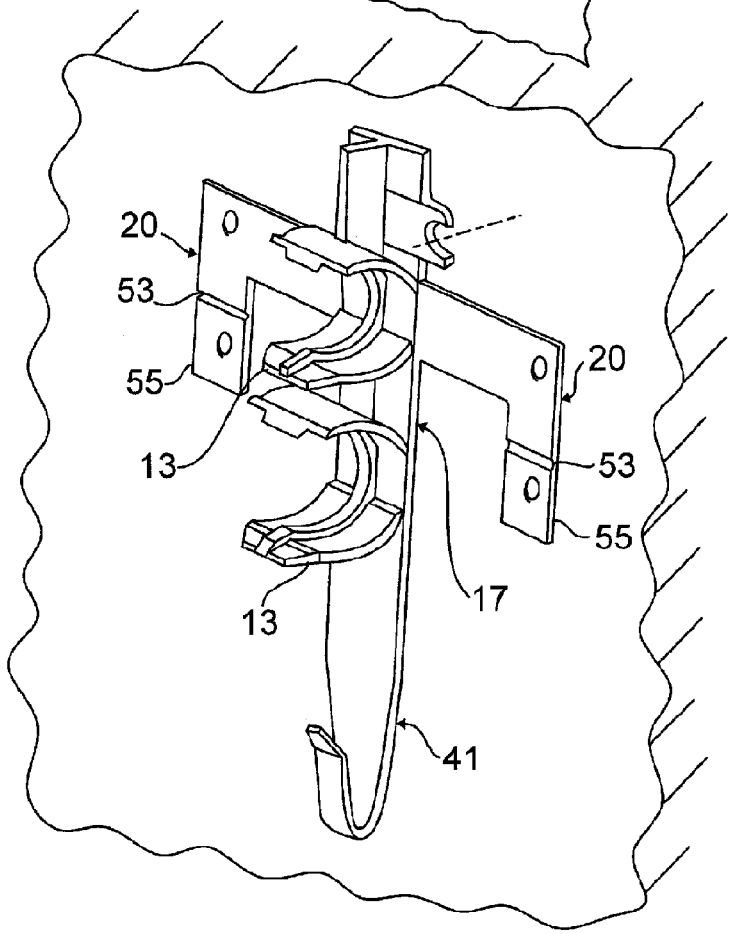
FIG. 4 a basic body of the mounting aid in its usage position.

The remaining base plate 17 of the mounting aid 11 can be attached in accordance with FIG. 4 independently of the dishwasher to an adjoining mounting wall 35.

For this purpose an attachment bracket is formed directly on the base plate 17 as a second attachment point 37 which is attached via a screw connection 39 to the mounting wall 35. Depending on the mounting conditions, the feed hose and drain hose can thus be held at a distance from the dishwasher on adjoining furniture walls or on the kitchen wall.

A hook section 41 is provided as a further functional part which extends the base plate 17 vertically downwards. The hook section 41 is formed by contrast with the other functional parts 20, 25 without an intermediate separating point on the base plate 17 and is used for suspending further additional parts such as a bag for operating instructions.

Figure 5:
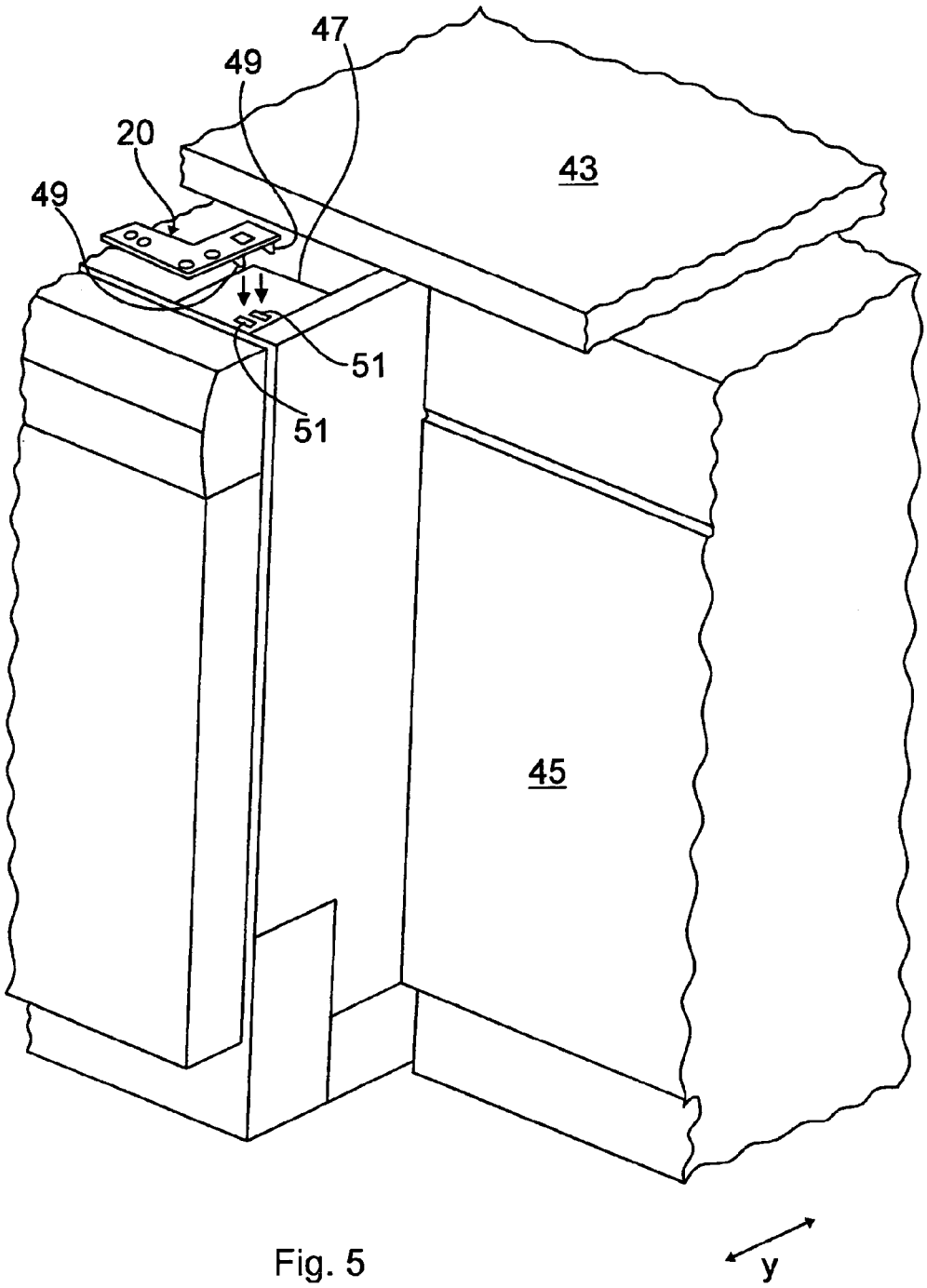
FIG. 5 the mounting of an attachment element separated from the basic body of the mounting aid.

As already mentioned, the mounting position and the functioning of the attachment brackets 20 molded laterally onto the base plate 17 is described in FIG. 5. FIG. 5 shows the mounting situation of a dishwasher embodied as a built-under appliance. In a depth direction y the dishwasher is pulled out of the build-under space which is delimited via an upper worktop 43 and an adjacent piece of furniture 45. In the upper side of the dishwasher that is revealed there is a right angled receiving element 47 provided in the front edge area from which one of the two attachment brackets 20 is shown at a distance.

As can be seen from FIG. 5, the attachment bracket 20 shown has two insertion tabs 49 protruding downwards which are inserted in the direction of the arrows into receiving slots 51 of the receiving element 47. Subsequently the dishwasher is pushed in the depth direction y into its built-in position so that the attachment bracket 20 lies opposite the underside of the worktop 43 and can be screwed to the latter.

In the event of the worktop 43 being made of marble for example it is not possible to screw on the attachment bracket 20. That this reason the two attachment brackets 20 have film hinges 53 with which screw attachments 55 can be folded down from the attachment brackets 20. In this way it is made possible for the attachment brackets 20 to be screwed to the lateral adjoining vertical furniture walls instead of to the worktop 43.

LIST OF REFERENCE SIGNS

1 Washing container
3 Rear wall
5 Connecting flange
7 Top wall
9 Side wall
11 Mounting aid
13 Hose holder
15 Feed hose
17 Base plate
18 Front side
19 Narrow edge sides
20 Attachment bracket

21 Separation point
23 Mounting arm
25 Anti-tip part
26 Securing arm
27 First attachment points
28 Reinforcing rib
29 Attachment flange
31 Screw connection
33 Recess
35 Mounting wall
37 Attachment tab
39 Screw connection
41 Hook section
43 Worktop
45 Furniture unit
47 Receiving element
49 Insertion tabs
51 Receiving slots
53 Film bracket
55 Screw attachments
y Depth direction

The invention claimed is:

1. A household appliance, comprising:

a housing;

a mounting aid for the housing, the mounting aid having at least two functional parts that are separable from one another by at least one separation point, wherein a first functional part of the at least two functional parts is configured to hold additional parts or accessories of the household appliance, and wherein a second functional part of the at least two functional parts is configured to facilitate a stable mounting of the housing.

2. The household appliance of claim 1, wherein the household appliance is a dishwasher.

3. The household appliance of claim 1, wherein the at least one separation point is one of an intended break point and a bending point.

4. The household appliance of claim 3, wherein the mounting aid is a uniform material and one piece.

5. The household appliance of claim 1, wherein the first functional part is a hose holder.

6. The household appliance of claim 1, wherein the second functional part is an attachment bracket to secure the household appliance against being pulled out of a built-in position of the household appliance.

7. The household appliance of claim 1, wherein the mounting aid is a plastic injection molded part.

8. The household appliance of claim 1, wherein the mounting aid is configured to be arranged on an outside of the housing.

9. The household appliance of claim 1, wherein the number of separation points is equal to or greater than the number of functional parts of the mounting aid.

10. The household appliance of claim 1, wherein the mounting aid has a first attachment point to mount the mounting aid on the household appliance.

11. The household appliance of claim 10, wherein the first attachment point of the mounting aid is provided at a third functional part of the at least two functional parts, and wherein the third functional part is an anti-tip part.

12. The household appliance of claim 10, wherein the mounting aid has a second attachment point for wall-mounting the mounting aid independently of the household appliance.

13. The household appliance of claim 12, wherein the mounting aid has a base plate as a basic body of the mounting aid, and wherein functional elements are molded on a narrow side of the base plate.

14. The household appliance of claim 13, wherein the second attachment point is provided directly on the basic body.

15. The household appliance of claim 14, wherein respective surfaces of the functional elements and the base plate are aligned flush with one another.

16. The household appliance of claim 1, wherein a third functional part of the at least two functional parts is an anti-tip part.

17. The household appliance of claim 16, wherein a fourth functional part of the at least two functional parts is a hook to suspend the additional parts.

18. The household appliance of claim 16, wherein the anti-tip part has a securing arm which, in a usage position of the securing arm, engages with the household appliance.

19. The household appliance of claim 16, wherein the anti-tip part has a mounting arm for wall-mounting.

20. The household appliance of claim 19, wherein the mounting arm has an attachment flange for wall mounting.

21. The household appliance of claim 18, wherein the securing arm has at least one recess which, in a usage position of the securing arm, grips a rear-side connection flange of a feed container of the household appliance.

22. The household appliance of claim 18, wherein a first attachment point of the mounting aid is positioned on the securing arm of the anti-tip part and is arranged to hold the mounting aid on the household appliance.

23. A mounting aid for a household appliance, comprising:

a unitary structure configured to be attached to the housing of a household appliance to facilitate usage of the household appliance, the unitary structure including at least two functional parts that are separable from one another by at least one separation point, the at least two functional parts being configured to also be separately used to facilitate usage of the household appliance.

24. The mounting aid of claim 23, wherein the unitary structure has a recess configured to receive a portion of the housing to attach the unitary structure to the housing.

25. A household appliance, comprising:

a housing; and the mounting aid of claim 23.

26. The household appliance of claim 25, wherein a first functional part of the at least two functional parts is a hose holder.

27. The household appliance of claim 26, wherein a second functional part of the at least two functional parts is an attachment bracket to secure the household appliance against being pulled out of a built-in mounting position of the household appliance.

28. The household appliance of claim 27, wherein the household appliance is a dishwasher.

* * * * *